US011071424B2

(12) United States Patent
Peng et al.

(10) Patent No.: US 11,071,424 B2
(45) Date of Patent: Jul. 27, 2021

(54) FLOOR BRUSH FOR CLEANING APPLIANCE AND CLEANING APPLIANCE HAVING SAME

(71) Applicant: MIDEA GROUP CO., LTD., Foshan (CN)

(72) Inventors: Xiaokang Peng, Foshan (CN); Siyu Jin, Foshan (CN); Zhonghua Li, Foshan (CN)

( * ) Notice: Subject to any disclaimer, the term of this patent is extended or adjusted under 35 U.S.C. 154(b) by 356 days.

(21) Appl. No.: 16/233,127

(22) Filed: Dec. 27, 2018

(65) Prior Publication Data

US 2019/0125149 A1 May 2, 2019

Related U.S. Application Data

(63) Continuation of application No. PCT/CN2016/104126, filed on Oct. 31, 2016.

(30) Foreign Application Priority Data

Aug. 15, 2016 (CN) ..... 201610669546.5
Aug. 15, 2016 (CN) ..... 201620881730.1

(51) Int. Cl.
*A47L 9/06* (2006.01)

(52) U.S. Cl.
CPC ..... *A47L 9/0626* (2013.01)

(58) Field of Classification Search
CPC ..... A47L 5/30; A47L 9/0477; A47L 9/0411; A47L 9/04; A47L 5/34; A47L 9/0626;
(Continued)

(56) References Cited

U.S. PATENT DOCUMENTS 4,638,526 A * 1/1987 Murata ..... A47L 9/06 15/367
6,009,594 A * 1/2000 Grey ..... A47L 11/30 15/322

(Continued)

FOREIGN PATENT DOCUMENTS

CN 101313830 A 12/2008
CN 201861563 U 6/2011

(Continued)

OTHER PUBLICATIONS

The Office Action dated Jul. 2, 2019 in the corresponding EP application No. 16913371.7.

(Continued)

*Primary Examiner* — Robert J Scruggs
(74) *Attorney, Agent, or Firm* — Kilpatrick Townsend & Stockton, LLP

(57) ABSTRACT

Disclosed are a floor brush of a dust collector and a dust collector having same, the floor brush of a dust collector comprising: a main body, the main body defining an air channel therein and being provided with, on a lower surface at the front end thereof, a suction port in communication with the air channel, when the main body covers a surface to be cleaned, an air-tight space being formed between the air channel and the surface to be cleaned, and the front end of the main body being provided with a front air inlet port in communication with the air channel; and a flow guiding portion, the flow guiding portion being provided at the front end of the main body and being provided adjacent to the front air inlet port, and the flow guiding face so that the external air passes through the flow guiding face and the front air inlet port into the air channel.

17 Claims, 5 Drawing Sheets

(58) Field of Classification Search
CPC ..... A47L 9/0686; A47L 9/02; A47L 9/0613; A47L 5/28; A47L 9/06
See application file for complete search history.

(56) References Cited

U.S. PATENT DOCUMENTS

| | | | | |
|---|---|---|---|---|
| 2002/0083552 | A1 | 7/2002 | Dilger et al. | |
| 2003/0163889 | A1* | 9/2003 | Bagwell ..... | A47L 9/02 15/398 |
| 2010/0319159 | A1 | 12/2010 | Gell et al. | |
| 2016/0113458 | A1 | 4/2016 | Song et al. | |

FOREIGN PATENT DOCUMENTS

| | | | |
|---|---|---|---|
| CN | 201899445 | U | 7/2011 |
| CN | 104703524 | A | 6/2015 |
| CN | 105101856 | A | 11/2015 |
| CN | 105167713 | A | 12/2015 |
| CN | 205411083 | U | 8/2016 |
| CN | 105942926 | A | 9/2016 |
| CN | 105996899 | A | 10/2016 |
| CN | 106175588 | A | 12/2016 |
| CN | 206044534 | U | 3/2017 |
| CN | 206443652 | U | 8/2017 |
| EP | 0885586 | A1 | 12/1998 |
| EP | 2457481 | A1 | 5/2012 |
| WO | 0226098 | A1 | 4/2002 |

OTHER PUBLICATIONS

The first Office Action dated Jan. 30, 2018 in the corresponding CN application No. 201610669546.5.
The second Office Action dated Sep. 28, 2018 in the corresponding CN application No. 201610669546.5.
The third Office Action dated Jun. 4, 2019 in the corresponding CN application No. 201610669546.5.
International Search Report dated May 10, 2017 in the corresponding International Application No.PCT/CN2016/104126.

* cited by examiner

FLOOR BRUSH FOR CLEANING APPLIANCE AND CLEANING APPLIANCE HAVING SAME

CROSS-REFERENCE TO RELATED APPLICATION

This application is a continuation of International Application No. PCT/CN2016/104126, filed on Oct. 31, 2016, which claims priority to and benefits of Chinese Patent Application Serial No. 201620881730.1 and 201610669546.5, filed with China National Intellectual Property Administration on Aug. 15, 2016, the entire content of which is incorporated herein by reference.

FIELD

The present disclosure relates to a technical field of household appliances for cleaning, and more particularly to a floor brush for a cleaning appliance and a cleaning appliance having the same.

BACKGROUND

A cleaning appliance is a kind of household appliance that can suck debris such as dusts and hairs by generating negative pressure, so as to achieve cleaning effect. The main components of the cleaning appliance include a main body for generating suction force, the main body including an electric motor, a filter, a dust colleting device and etc., a floor brush for the cleaning appliance contacting a floor to be cleaned for sucking debris, and a soft tube for connecting the main body and the floor brush.

The performance of the cleaning appliance is dependent on two factors including a high suction force and a low noise. The high suction force is mainly dependent on the performance of the electric motor and the suction force necessary by the cleaning appliance can be satisfied by the substantially all of the electric motors of current cleaning appliance. The problem of noise in the current cleaning appliance needs to be solved urgently. The noise in the cleaning appliance mainly comes from the main body and the floor brush. The main body produces the noise due to high-speed operation and mechanical vibration of the electrical motor inside, and the floor brush mainly produces pneumatic noise as a result of high-speed flow of airflow of air (simplified as "airflow" below). In the related art, the noise produced by the floor brush has been well-matched with or even higher than the noise produced by the main body.

SUMMARY

The present disclosure aims to solve one of the technical problems existing in the related art. Thus, one embodiment of the present disclosure is to provide a floor brush for a cleaning appliance, which can reduce the noise caused by high-speed flowing of airflow in the floor brush when the floor brush operates on the surface to be cleaned.

Another embodiment of the present disclosure is to provide a cleaning appliance having the above-mentioned floor brush.

The floor brush according to the present disclosure includes: a body having an air channel and a suction port communicated with the air channel, the air channel being formed in the body and the suction port being formed in a lower surface at a front end of the body, the air channel being configured so that when the body covers a surface to be cleaned, an airtight space is formed between the air channel and the surface to be cleaned, and a front air inlet communicated with the air channel being formed at the front end of the body; and an airflow guiding portion arranged at the front end of the body and adjacent to the front air inlet, the airflow guiding portion having an airflow guiding surface so that external air enters the air channel through the airflow guiding surface and the front air inlet.

In the floor brush according to the present disclosure, by providing the airflow guiding portion having the airflow guiding surface, when the external air is sucked into the floor brush along the airflow guiding surface, a flowing state of airflow entering the floor brush can be improved, the airflow is enabled to flow more stably, which reduces the turbulent kinetic energy and the degree of turbulence of the air flowing and hence lowers the aerodynamic noise.

In addition, the floor brush according to the present disclosure can also have the following additional technical features.

According to an embodiment of the present disclosure, the airflow guiding surface is located in a lower surface of the airflow guiding portion and includes at least one of a front airflow guiding surface and a rear airflow guiding surface, the front airflow guiding surface is inclined downwards from front to rear, and the rear airflow guiding surface is inclined upwards from the front to the rear.

In one embodiment, the at least one of the front airflow guiding surface and the rear airflow guiding surface is formed into at least one arc surface, at least one flat surface, or a combination of at least one arc surface and at least one flat surface.

In one embodiment, the front airflow guiding surface is configured so that an included angle $\alpha$ between a tangential line at any point in the front airflow guiding surface and the surface to be cleaned is less than 60°.

Further, the rear airflow guiding surface is configured so that an included angle $\beta$ between a tangential line at any point in the rear airflow guiding surface and the surface to be cleaned is less than 20°.

According to an embodiment of the present disclosure, a length L1 of a projection of the front airflow guiding surface on the surface to be cleaned in a front and rear direction is greater than 2 mm, and a length L2 of a projection of the rear airflow guiding surface on the surface to be cleaned in the front and rear direction is greater than 6 mm.

According to an embodiment of the present disclosure, the floor brush further includes a front dust collecting strip, the front dust collecting strip is arranged at the front end of the body and the front air inlet is formed in the front dust collecting strip.

According to an embodiment of the present disclosure, when the airflow guiding surface includes the front airflow guiding surface and the rear airflow guiding surface, the front dust collecting strip is located between the front airflow guiding surface and the rear airflow guiding surface.

According to an embodiment of the present disclosure, a groove being recessed upwards is formed in a part, located between the front airflow guiding surface and the rear airflow guiding surface, of the airflow guiding portion, an upper end of the front dust collecting strip extends into the groove and a lower end of the front dust collecting strip extends downwards and exceeds the airflow guiding portion so as to support the floor brush on the surface to be cleaned.

According to an embodiment of the present disclosure, the smallest value C of a vertical distance between the upper end of the front air inlet and the airflow guiding surface is less than or equal to 2 mm.

According to an embodiment of the present disclosure, a plurality of front air inlets are provided and formed in the front dust collecting strip at intervals.

According to an embodiment of the present disclosure, the floor brush further includes a small supporting wheel, the small supporting wheel is arranged at a left and/or right side of the front dust collecting strip, the small supporting wheel is attached to the front dust collecting strip or an element made of sealing material is filled between the small supporting wheel and the front dust collecting strip.

According to an embodiment of the present disclosure, the air channel includes a first wall surface and a second wall surface, the first wall surface is connected to a rear end of the airflow guiding surface and obliquely extends upwards and backwards, and the second wall surface is opposite to the first wall surface.

In one embodiment, an included angle γ 1 is formed at a joint between the first wall surface and the airflow guiding surface and the included angle γ 1 is equal to or greater than 90 degree and is less than or equal to 130 degree.

According to an embodiment of the present disclosure, the smallest distance D1 between the second wall surface and the surface to be cleaned and the greatest distance D2 between the rear airflow guiding surface and the surface to be cleaned satisfy that D1 is less than or equal to D2.

In one embodiment, an included angle γ 2 between a tangential line at any point on the second wall surface and the surface to be cleaned is γ 2, and the included angle γ 2 is greater than 0 degree and less than or equal to 50 degree.

According to an embodiment of the present disclosure, a side air inlet communicated with the air channel is formed in at least one side of the body.

The cleaning appliance according to embodiments of the present disclosure includes a cleaning appliance body and the floor brush according to embodiments of the present disclosure.

Embodiments of present disclosure will be given in part in the following descriptions, become apparent in part from the following descriptions, or be learned from the practice of the embodiments of the present disclosure.

BRIEF DESCRIPTION OF THE DRAWINGS

Embodiments of the present disclosure will become apparent and more readily appreciated from the following descriptions made with reference to the drawings.

REFERENCE NUMERALS

Figure 1:
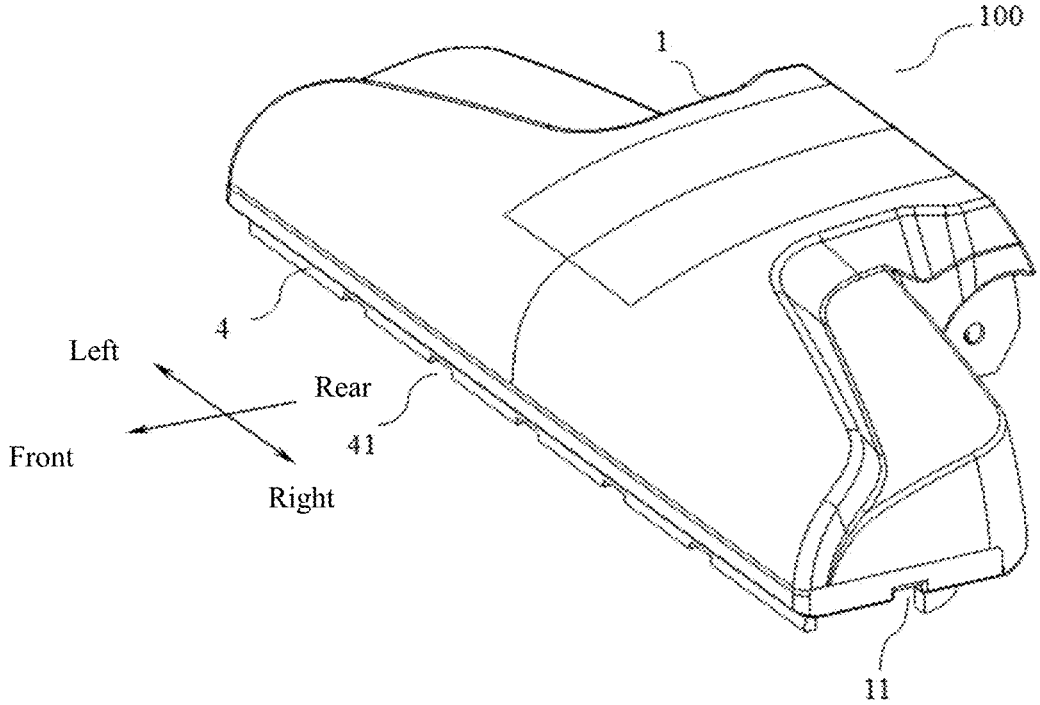
FIG. 1 is a schematic view of a floor brush for a cleaning appliance according to an embodiment of the present disclosure.

100: floor brush for cleaning appliance; 101: reference floor brush; 102: microphone;
1: body; 11: side air inlet; 12: suction port;
2: air-flow guiding portion; 21: air-flow guiding surface; 22: groove;
211: front air-flow guiding surface; 212: rear air-flow guiding surface; 2121: first flat surface; 2122: second flat surface;
3: air channel; 31: first wall surface; 32: second wall surface; 33: outlet;
4: front dust-collecting strip; 41: front air inlet;
5: small supporting wheel;
6: connector;
7: surface to be cleaned;
8: rear dust collecting strip.

DETAILED DESCRIPTION

The embodiments of the present disclosure are described in detail below, and the examples of the embodiments are illustrated in the drawings, in which the same or similar reference numerals are used to refer to the same or similar elements or elements having the same or similar functions. The embodiments described below with reference to the drawings are illustrative of the embodiments the present disclosure.

In the description of the present disclosure, it should be understood that, terms such as "central", "upper," and "lower" should be construed to refer to the orientation as then described or as illustrated in the drawings under discussion. These relative terms are for convenience of description and may not require that the present disclosure be constructed or operated in a particular orientation. Therefore, the above terms should not be construed to limit the present disclosure.

In the present disclosure, unless specified or limited otherwise, the terms "mounted," "connected," "coupled" and the like are used broadly, and may be, for example, fixed connections, detachable connections, or integral connections; may also be direct connections or indirect connections via intervening structures; may also be inner communications of two elements.

A floor brush 100 for a cleaning appliance according to embodiments of the present disclosure is described in the following with reference to FIG. 1 to FIG. 10. The floor brush 100 can be used in a cleaning appliance such as a vacuum cleaner. In the following description of the present application, the floor brush 100 being used in the vacuum cleaner is taken as an example for illustration. Certainly, the floor brush 100 can also be used in cleaning appliances of other types, which is not limited to the vacuum cleaner.

As illustrated in FIG. 1 to FIG. 7, the floor brush 100 according to embodiments of a first aspect of the present disclosure includes a body 1 and an air-flow guiding portion 2.

An air channel 3 can be formed in the body 1, and a suction port 12 communicated with the air channel 3 is formed in a lower surface at a front end of the body 1, and the suction port 12 is located at an inlet end of the air channel 3. When the body 1 covers a surface 7 to be cleaned, an airtight space is formed between the air channel 3 and the surface 7, and a front air inlet 41 communicated with the air channel 3 is formed at the front end of the body 1. When the floor brush 100 is used in the cleaning appliance such as the vacuum cleaner, the cleaning appliance such as the vacuum cleaner operates, the lower surface at the front end of the body 1 contacts the surface 7, the surface 7 substantially closes the suction port 12, in which case the airtight space formed between the air channel 3 and the surface 7 is substantially tightly closed and negative pressure is produced at the airtight space by means of an electric motor of the cleaning appliance, so that external air can enter the cleaning appliance only through the front air inlet 41. The airflow entering the cleaning appliance from the front air inlet 41 can carry debris such as dust and hair on the surface 7 while flowing through the suction port 12, so that the carried debris such as the dust and hair can enter the air channel 3 along with the airflow, thus realizing the cleaning for the surface 7.

The air-flow guiding portion 2 is arranged in front of the body 1 and adjacent to the front air inlet 41. The air-flow guiding portion 2 has an air-flow guiding surface 21 so that the external air enters the air channel 3 through the air-flow guiding surface 21 and the front air inlet 41. Thus, by providing the air-flow guiding portion 2 having the air-flow guiding surface 21, the external air can flow towards the air channel 3 under an air-guiding action of the air-flow guiding surface 21 of the air-flow guiding portion 2, which improves the flowing condition of the airflow in the floor brush 100, so that pneumatic noise resulted by the high-speed flowing of the airflow in the floor brush 100 can be reduced.

In order to verify the noise reduction performance of the floor brush 100 according to the present disclosure, the noise and dust removal efficiency test and comparison is performed on a prototype (i.e. a full-scale model) made according to a structure of the floor brush 100 according to the present disclosure and a floor brush for a cleaning appliance (referred to as "reference floor brush 101" in the following description) which represents a general level of floor brush performance on the market.

Figure 8:
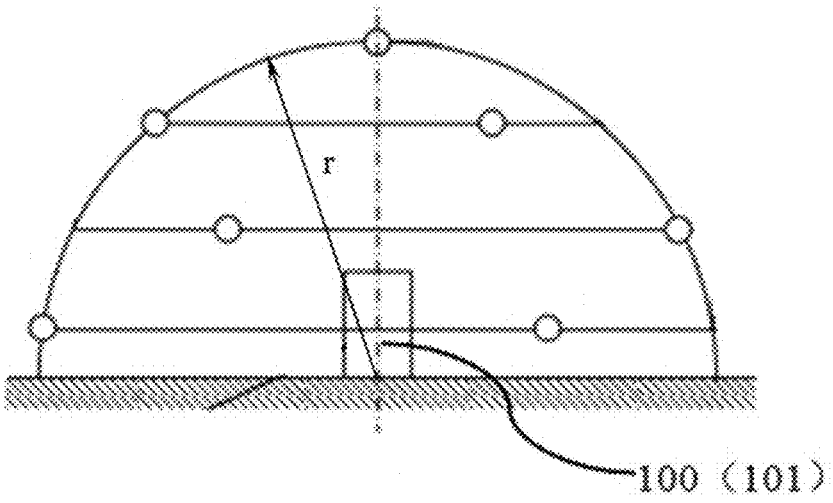
FIG. 8 is a front elevation view of a noise testing system for testing noise of a floor brush for a cleaning appliance.
Figure 9:
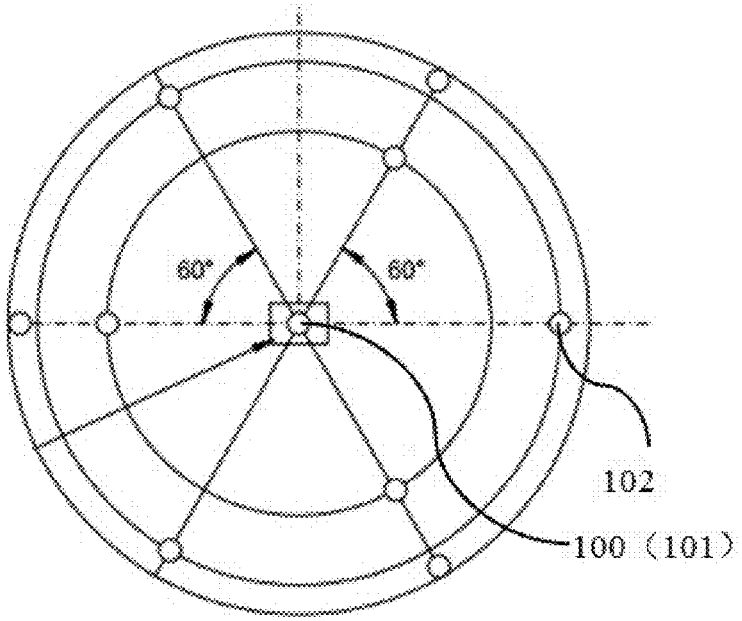
FIG. 9 is a top plan view of the noise testing system illustrated in FIG. 8.
Figure 10:
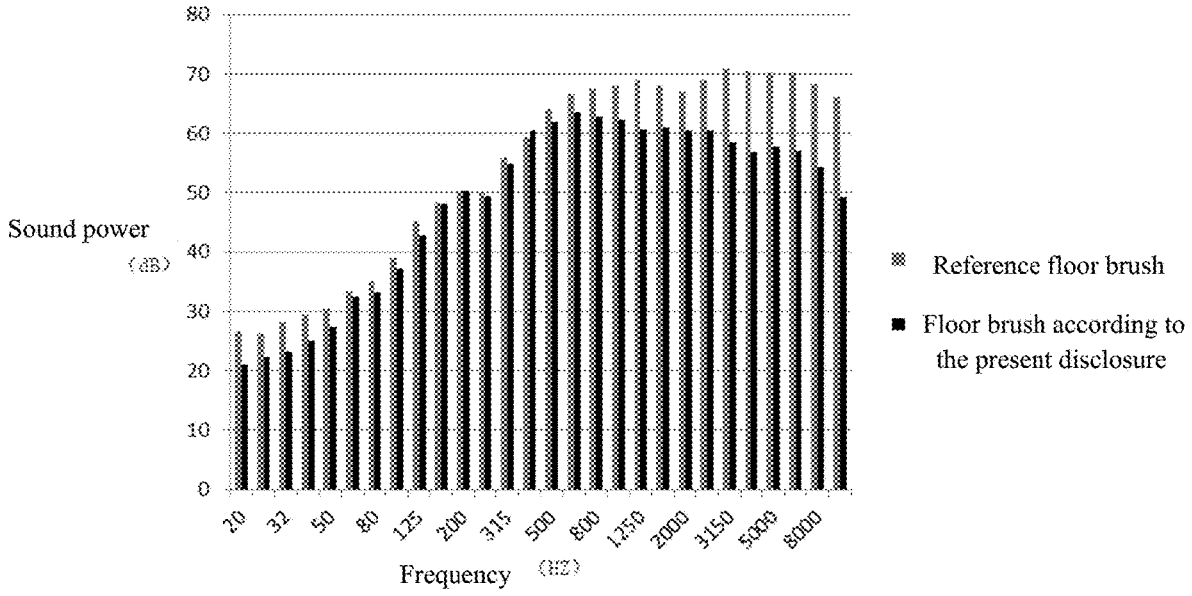
FIG. 10 is a comparison diagram illustrating a testing result of respective noise of a floor brush for a cleaning appliance according to an embodiment of the present disclosure and a reference floor brush at ⅓ octave.

The inventor refers to standard IEC60704-1 of test procedure for airborne noise made by household appliances and electrical appliances having similar purpose and arranges a position of a microphone 102 by a hemispherical points arrangement method as illustrated in FIG. 8 to FIG. 9, for example, a spherical radius r=1.5 m. When the noise test is performed on the floor brush 100, the floor brush 100 is placed at a center of a spherical surface, and when the noise test is performed on the reference floor brush 100, the reference floor brush 101 is also placed at the center of the spherical surface. After a number of noise tests, test results are illustrated in FIG. 10. The noise test results show that, the noise value of the cleaning appliance adopting the floor brush 100 according to the present disclosure is reduced by 7 dB (decibel), the noise values in a lower frequency band (<200 HZ) and a medium-high frequency band (>800 HZ) are greatly reduced, and the noise reduction effect is remarkable, compared with the reference floor brush 101.

The reason for the decrease of the noise value in the low frequency band is that the air-flow guiding surface 21 is provided, which eliminates a sudden change of an area when the airflow enters the airtight space, and reduces the generation of large airflow separation vortex. Similarly, the reason for the decrease of the noise in the high-frequency band is that the airflow guiding surface 21 is provided, which makes the airflow to flow more stably and reduces the turbulent kinetic energy and turbulence of the flow.

In addition, the inventor refers to part 5.1 of the standard IEC60312, after a plurality of dust removal efficiency tests, the test results show that the dust removal efficiency of the reference floor brush 101 is about 94.5%, and the dust removal efficiency of the floor brush 100 according to the present disclosure is 96%, so the dust removal efficiency is improved, the reason for which is that the floor brush 100 according to the present disclosure optimizes the air channel 3, reduces the air flowing resistance, and improves the dust removal efficiency.

As illustrated in FIG. 1 to FIG. 7, when the cleaning appliance such as the vacuum cleaner operates, the electric motor operates to generate the negative pressure (which is less than atmospheric pressure) in the air channel 3, the external air is sucked along the airflow guiding surface 21 into the air channel 3 through the front air inlet 41, and meanwhile the debris such as the hair and dust on the surface 7 are also sucked into the air channel 3 along with the air, so that the cleaning effect is achieved. By providing the airflow guiding surface 21, during the process of the air being sucked into the floor brush 100 along the airflow guiding surface 21, the air flows along the airflow guiding surface 21 smoothly, which reduces vortex caused by collision of the airflow with the surface 7 and eliminates the large separation vortex caused by the sudden change of the area, thereby reducing the energy loss of the airflow. As the energy is conserved, the energy loss of the airflow is low and hence the energy converted into acoustic energy is low, thereby reducing the aerodynamic noise. At the same time, the flow guiding surface 21 can guide the airflow, make the airflow to flow more stably, which reduces the turbulent kinetic energy and turbulence of the air flowing, thereby further lowering the aerodynamic noise.

In the floor brush 100 according to embodiments of the present disclosure, by providing the airflow guiding portion 2 having the airflow guiding surface 21, when the external air is sucked into the floor brush 100 along the airflow guiding surface 21, a flowing state of airflow entering the floor brush 100 can be improved, the vortex produced by collision of the airflow with the surface 7 can be reduced, a large separation vortex resulted by sudden area change is eliminated, so that energy loss of airflow decreases and the aerodynamic noise is reduced. Meanwhile, The guidance on the airflow by the airflow guiding surface 21 enables the airflow to flow more stably, which reduces the degree of turbulence of the air flowing and hence lowers the aerodynamic noise.

According to an embodiment of the present disclosure, the airflow guiding surface 21 is formed at a lower surface of the airflow guiding portion 2 and includes at least one of a front airflow guiding surface 211 and a rear airflow guiding surface 212. The front airflow guiding surface 211 is inclined downwards from front to rear, and the rear airflow guiding surface 212 is inclined upwards from front to rear. For example, as illustrated in FIG. 2 to FIG. 5, the airflow guiding surface 21 includes the front airflow guiding surface 211 and the rear airflow guiding surface 212, the external air firstly flows through the front airflow guiding surface 211 and then the rear airflow guiding surface 212 when flowing through the airflow guiding surface 21. A gap between the airflow guiding surface 21 and the surface 7 firstly increases and then decreases along a flowing direction of the airflow. By inclining the front airflow guiding surface 211 downwards from front to rear, a converging inlet is formed when the airflow flows through the front airflow guiding surface 211 from front to rear, which can reduce the vortex produced by collision of the airflow with the above-mentioned inlet, reduce the energy loss of the airflow and lower the aerodynamic noise. By inclining the rear airflow guiding surface 212 upwards from front to rear, the airflow channel is divergent while the airflow flows through the rear airflow guiding surface 212. According to Coanda effect (that is, when surface friction exists between fluid and an object surface which the fluid flows through, the fluid flows along the object surface as long as curvature of the object surface is not large), the airflow flows and attaches to the rear airflow guiding surface 212, which eliminates the separation vortex caused by a sudden change of a section area of the airflow channel, reduces turbulences of the air flowing and hence lowers the aerodynamic noise. In addition, as the rear airflow guiding surface 212 is inclined upwards from front to rear, a part of airflow is enabled to enter the air channel 3 along a tangential direction of a rear end of the rear airflow guiding surface 212 instead of along a direction parallel with the surface 7.

In one embodiment, the airflow guiding surface 21 only includes the rear airflow guiding surface 212 (not illustrated in the figure). The front airflow guiding surface doesn't apparently influence the Coanda effect of the rear airflow guiding surface 212. Thus, the airflow is attached to the rear airflow guiding surface 212 and flows, which can eliminate the separation vortex caused by the sudden change of the section area of the airflow channel, reduce degree of turbulence of the air flowing and hence lower the aerodynamic noise.

Certainly, the airflow guiding surface 21 can also include only the front airflow guiding surface 211, in which case an inclined angle of a wall surface of the air channel 3 in communication with the airflow guiding surface 21 is configured as a relatively small angle (not illustrated in the figures), so that the airflow enters the air channel 3 directly through the front airflow guiding surface 211 and the above-mentioned wall surface having the relatively small including angle, thus the degree of turbulence of air flowing is small and the aerodynamic noise is lowered.

In one embodiment, at least one of the front airflow guiding surface 211 and the rear airflow guiding surface 212 forms into at least one arc surface, at least one flat surface, or a combination of at least one arc surface and at least one flat surface. That is, when the airflow guiding surface includes only the front airflow guiding surface 211, the front airflow guiding surface 211 forms into at least one arc surface, at least one flat surface, or the combination of at least one arc surface and at least one flat surface; when the airflow guiding surface includes only the rear airflow guiding surface 212, the rear airflow guiding surface 212 forms into at least one arc surface, at least one flat surface, or the combination of at least one arc surface and at least one flat surface; when the airflow guiding surface 21 includes both of the front airflow guiding surface 211 and the rear airflow guiding surface 212, each of the front airflow guiding surface 211 and the rear airflow guiding surface 212 forms into at least one arc surface or at least one flat surface, or each of the front airflow guiding surface 211 and the rear airflow guiding surface 212 is constituted by at least one arc surface and at least one flat surface. It could be understood that specific shapes of the front airflow guiding surface 211 and the rear airflow guiding surface 212 can be designed according to actual requirement so as to meet the actual requirement better. For example, when the floor brush is limited by dimension and it is not suitable for the front airflow guiding surface 211 and the rear airflow guiding surface 212 to be designed into arc surfaces, the front airflow guiding surface 211 and the rear airflow guiding surface 212 can be configured as a combination of a certain quantity of flat surface and arc surface.

Figure 2:
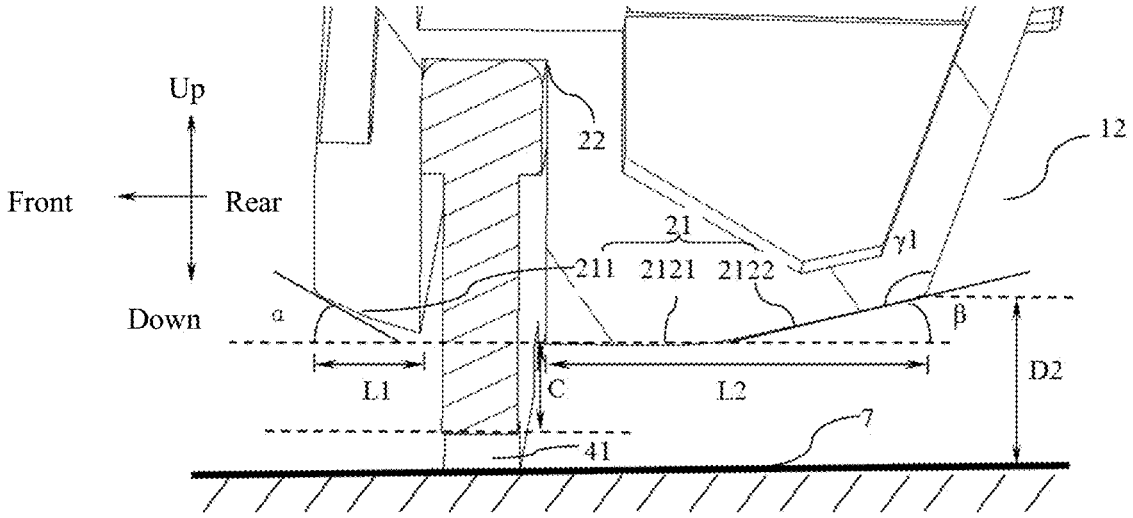
FIG. 2 is a partial section view at a suction port of a floor brush for a cleaning appliance according to an embodiment of the present disclosure.
Figure 4:
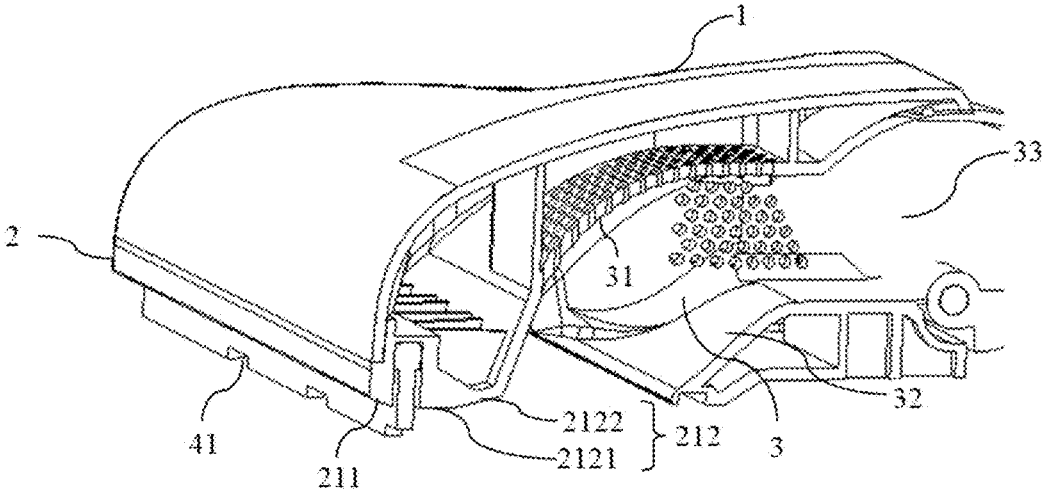
FIG. 4 is a section view of a floor brush for a cleaning appliance according to another embodiment of the present disclosure.

Specifically, as illustrated FIG. 2 and FIG. 4, the airflow guiding surface 21 includes the front airflow guiding surface 211 and the rear airflow guiding surface 212. The front airflow guiding surface is the arc surface and the rear airflow guiding surface 212 is the combination of a first flat surface 2121 and a second flat surface 2122, and the first flat surface 2121 and the second flat surface 2122 are connected through an arc in a smooth-transition manner. Thus, it is ensured that the airflow flows stably along the airflow guiding surface 21, the flowing resistance of the airflow is reduced, the energy loss of airflow decreases and hence the aerodynamic noise is lowered. With the rear airflow guiding surface 212 being the combination of the first flat surface 2121 and the second flat surface 2122 and the first flat surface 2121 and the second flat surface 2122 being connected in the smooth-transition manner, a divergent channel where the air enters the air channel 3 of the floor brush 100 through the front air inlet 41 is more smooth, and the airflow is attached to the rear airflow guiding surface 212 and flows, which eliminates the separation vortex caused by the sudden change of the section area of the airflow channel, reduces degree of turbulences of the air flowing and hence lowers the aerodynamic noise.

Figure 3:
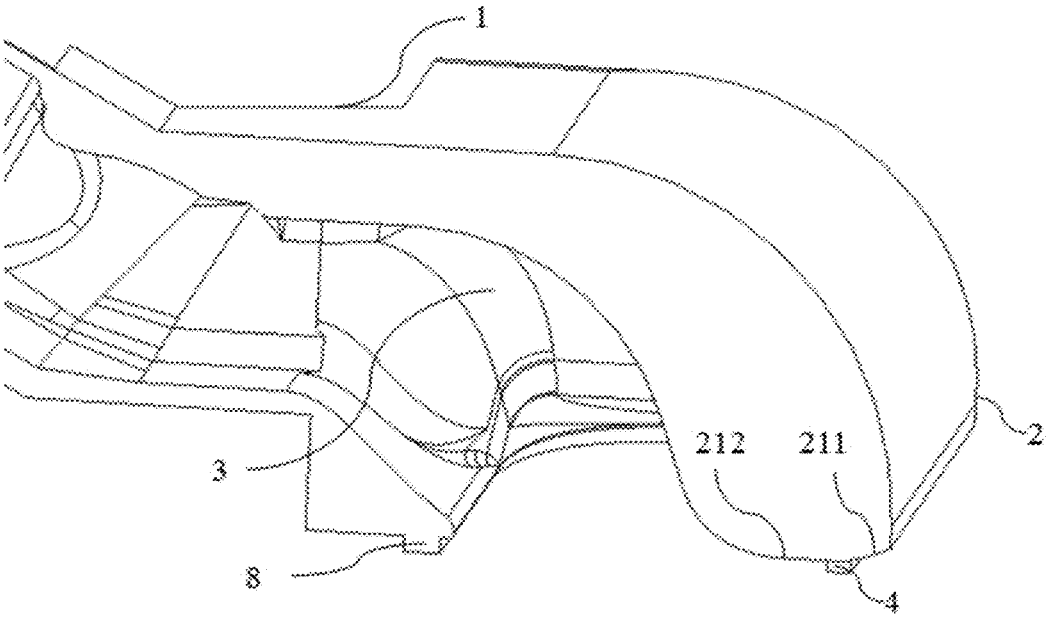
FIG. 3 is a section view of a floor brush for a cleaning appliance according to an embodiment of the present disclosure.

Certainly, the front airflow guiding surface 211 and the rear airflow guiding surface 212 can both be the arc surface, as illustrated in FIG. 3. Thus, the airflow flows stably along the front airflow guiding surface 211 and the rear airflow guiding surface 212, which can reduce the flowing resistance and meanwhile the front airflow guiding surface 211 and the rear airflow guiding surface 212 are easy to process.

In one embodiment, when the airflow guiding surface 21 includes the front airflow guiding surface 211, the front airflow guiding surface 211 is configured so that an included angle $\alpha$ between a tangential line at any point of the front airflow guiding surface 211 and the surface 7 is less than 60°. When the front airflow guiding surface 211 is at least one arc surface, the included angle $\alpha$ between the tangential line at any point of the at least one arc surface and the surface 7 satisfies that a is less than 60°. When the front airflow guiding surface 211 is at least one flat surface, the tangential line at any point of the at least flat surface is parallel with the at least flat surface, so the included angle $\alpha$ between each of the at least one flat surfaces and the surface 7 satisfies that a is less than 60°. When the front airflow guiding surface 211 is the combination of the at least one flat surface and the at least arc surface, the included angle $\alpha$ between each of all of the flat surface and the surface 7 satisfies that a is less than 60°, and the included angle $\alpha$ between the tangential line at any point of all of the arc surfaces and the surface 7 satisfies that a is less than 60°.

For example, as illustrated in FIG. 2, the front airflow guiding surface 211 is the arc surface, and the included angle $\alpha$ between the tangential line at any point of the arc surface and the surface 7 is less than 60°. Thus, the compact of the airflow on a front end of the front airflow guiding surface 211 is lowered, the energy loss of airflow is reduced, and hence the compacting noise is lowered. Meanwhile, the shape of arc surface of the front airflow guiding surface 211 also has a guiding effect on the airflow, which reduces the degree of turbulence of the air flowing and hence reduces the aerodynamic noise.

Further, when the airflow guiding surface 21 includes the rear airflow guiding surface 212, the rear airflow guiding surface 212 is configured so that an included angle β between a tangential line at any point of the rear airflow guiding surface 212 and the surface 7 is less than 20°. When the rear airflow guiding surface 212 is at least one arc surface, the included angle β between the tangential line at any point of the at least one arc surface and the surface 7 satisfies that β is less than 20°. When the rear airflow guiding surface 212 is at least one flat surface, the tangential line at any point of the at least flat surface is parallel with the at least flat surface, so the included angle β between each of the at least flat surface and the surface 7 satisfies that β is less than 20°. When the rear airflow guiding surface 212 is the combination of the at least one flat surface and the at least arc surface, the included angle β between each of all of the flat surface and the surface 7 satisfies that β is less than 20°, and the included angle β between the tangential line at any point of all of the arc surfaces and the surface 7 satisfies that β is less than 20°.

For example, as illustrated in FIG. 2 and FIG. 4, the rear airflow guiding surface is the combination of the first flat surface 2121 and the second flat surface 2122, and the first flat surface 2121 and the second flat surface 2122 are connected through arc in the smooth transition manner. An included angle between the second flat surface 2122 and the surface 7 is greater than an included angle between the first flat surface 2121 and the surface 7. The included angle β between the second surface 2122 and the surface 7 satisfies that β is less than 20°. Thus, in the divergent channel where the airflow enters the air channel 3 of the floor brush 100 through the front air inlet 41, the airflow is attached to the rear airflow guiding surface 212 and flows more stably, which eliminates the separation vortex caused by the sudden change of the section area of the airflow channel, reduces degree of turbulences of the air flowing and hence lowers the aerodynamic noise.

According to an embodiment of the present disclosure, as illustrated in FIG. 2, when the airflow guiding surface 21 includes the front airflow guiding surface 211, a length L1 of a projection of the front airflow guiding surface 211 on the surface 7 in a front and rear direction is greater than 2 mm, and when the airflow guiding surface 21 includes the rear airflow guiding surface 212, a length L2 of a projection of the rear airflow guiding surface 212 on the surface 7 in the front and rear direction is greater than 6 mm. Thus, a length of the converging airflow channel or the divergent airflow channel is guaranteed.

Figure 5:
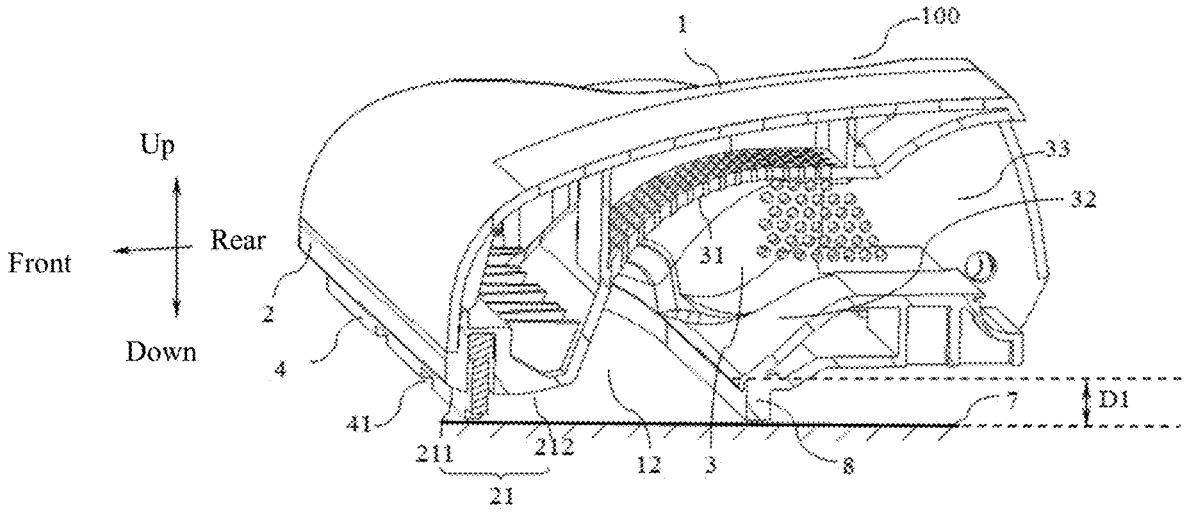
FIG. 5 is a section view of a floor brush for a cleaning appliance according to an embodiment of the present disclosure.

In a further embodiment of the present disclosure, as illustrated in FIG. 1 and FIG. 5, the floor brush 100 further includes a front dust collecting strip 4. The front dust collecting strip 4 is arranged at the front end of the body 1 and the front air inlet 41 is formed in the front dust collecting strip 4. For example, as illustrated in FIG. 5, the front air inlet 41 can be formed by a part of a lower surface of the front dust collecting strip 4 being recessed upwards, and the front air inlet 41 runs through a front surface and a rear surface of the front dust collecting strip 4 in the front and rear direction. When the airflow passes through the front air inlet 41, the section area of the airflow channel is reduced, the airflow is sped up and the debris on the surface 7 is carried into the air channel, so that the cleaning effect is achieved.

In one embodiment, the front dust collecting strip 4 is a plate strip made of plastic or plastic hair, but is not limited to that.

In one embodiment, the front air inlet 41 is a rectangular, trapezoidal or semicircular aperture.

According to an embodiment of the present disclosure, when the airflow guiding surface 21 includes the front airflow guiding surface 211 and the rear airflow guiding surface 212, the front dust collecting strip 4 is located between the front airflow guiding surface 211 and the rear airflow guiding surface 212. As illustrated in FIG. 2 and FIG. 5, the front dust collecting strip 4 separates the airflow guiding surface 21 into the front airflow guiding surface 211 and the rear airflow guiding surface 212, that is, the front dust collecting strip 4 separates the converging channel formed by the front airflow guiding surface 211 and the surface 7 and the divergent channel formed by the rear airflow guiding surface 212 and the surface 7 apart, that is, the front dust collecting strip 4 is located between the converging channel and the divergent channel. Furthermore, the converging channel and the divergent channel are communicated through the front air inlet 41 formed in the front dust collecting strip 4, when the airflow passes through the front air inlet 41, the flowing is accelerated, so that it is more easy for the airflow to carry the heavier debris on the surface 7 in front of the front air inlet 41 and the cleaning effect is better.

According to an embodiment of the present disclosure, a groove 22 being recessed upwards is formed in a part, located between the front airflow guiding surface 211 and the rear airflow guiding surface 212, of the airflow guiding portion 2. An upper end of the front dust collecting strip 4 extends into the groove 22 and a lower end of the front dust collecting strip 4 extends downwards and exceeds the airflow guiding portion 2 so as to support the floor brush 100 on the surface 7. For example, as illustrated in FIG. 2 and FIG. 5, a cross section of the front dust collecting strip 4 can substantially be in T shape, and the upper end of the front dust collecting strip 4 is snap-fitted in the groove 22 and the lower end of the front dust collecting strip 4 extends downwards and exceeds the airflow guiding surface 21 of the airflow guiding portion 2 so as to play a role of supporting the floor brush 100. Thus, the airflow guiding surface 21 is separated from the surface 7 in an up and down direction, so that the airflow can flow towards the air channel 3 better under the airflow guiding function of the airflow guiding surface 21, and meanwhile the airtight space is separated from the surface 7 in front of the front dust collecting strip 4 in the front and rear direction. Thus, when the cleaning appliance such as the vacuum cleaner operates, the negative pressure is generated in the airtight space, and the external air flows along the front airflow guiding surface 211 and towards the rear airflow guiding surface 212 through the front dust collecting strip 4, and then into the air channel 3, and during the process, the debris on the surface 7 in front of the front dust collecting strip 4 can be sucked into the air channel 3 along with the air, which enlarges the cleaning area of the cleaning appliance and improves the cleaning efficiency.

Figure 6:
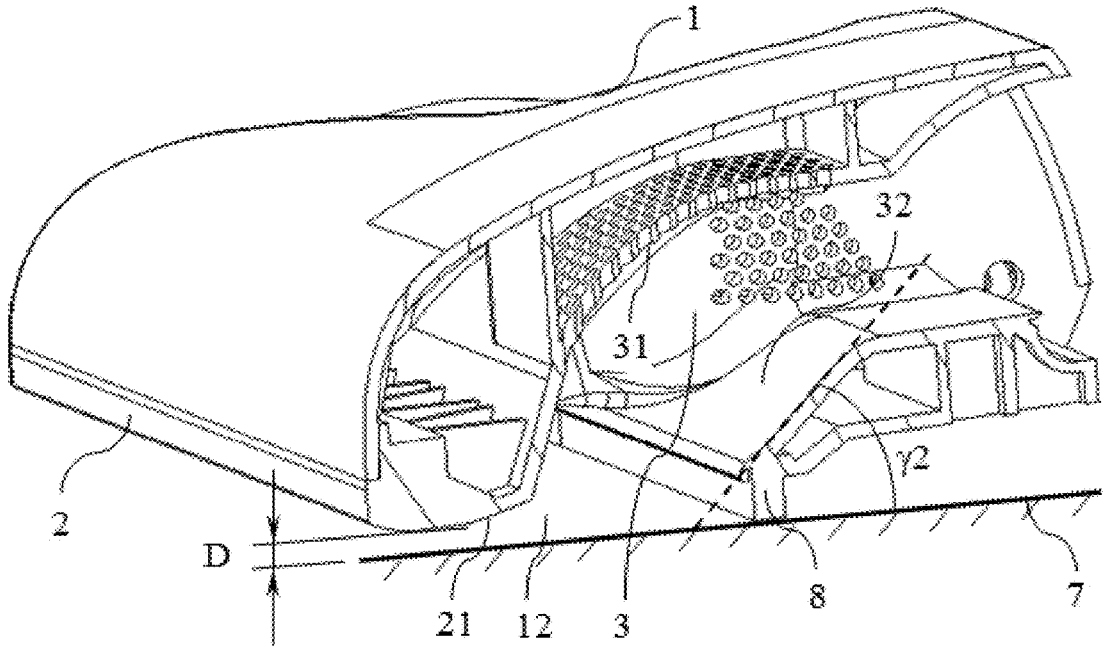
FIG. 6 is a section view of a floor brush for a cleaning appliance according to yet another embodiment of the present disclosure.

In one embodiment, the front dust collecting strip 4 can be removed from the floor brush 100, in which case the groove 22 may not be required to be provided and the airflow guiding surface 21 has a smooth transition and a less distance D from the surface 7, for example, the distance D satisfies that D is equal to or less than 2 mm. As illustrated in FIG. 6, according to an embodiment of the present disclosure, the smallest value C of a vertical distance between the upper end of the front air inlet 41 and the airflow guiding surface 21 is less than or equal to 2 mm, that is C satisfies that C≤52 mm, as illustrated in FIG. 2. Thus, it is ensured that airflow channels in front of or behind of the front air inlet 41 exhibit a converging or a divergent state while the airflow flows through the airflow guiding surface 21, and the sudden change of the section area of the airflow channel doesn't occur, which eliminates the separation vortex caused by the sudden change of the section area, reduces turbulences of the air flowing and hence lowers the aerodynamic noise According to an embodiment of the present disclosure, a plurality of front air inlets 41 can be provided, and the plurality of front air inlet 41 is arranged in the front dust collecting strip 4 and spaced apart from each other. In one embodiment, the plurality of front air inlet 41 is evenly distributed in the front dust collecting strip 4. For example, in an example illustrated in the FIG. 1, five front air inlets 41 are provided, and the five front air inlets 41 are evenly distributed in a length direction of the front dust collecting strip 4.

In one embodiment, the plurality of front air inlets 41 can also be unevenly distributed in the front dust collecting strip 4 (not illustrated in the figures). For example, the plurality of front air inlets 41 are arranged symmetrically along a left and right direction of the front dust collecting strip 4, and distances between two adjacent front air inlets 41 are not even. For example, a distance between two adjacent front air inlets 41 close to a center of the front dust collecting strip 4 in a length direction of the front dust collecting strip 4 is small, and a distance between two adjacent front air inlet 41 away from the center of the front dust collecting strip 4 in the length direction of the front dust collecting strip is large, that is, the distance between two adjacent front air inlets 41 increase gradually in a direction from the center of the front dust collecting strip 4 to each of two ends of the front dust collecting strip 4. Thus, as the front air inlet 41 adjacent to the center of the front dust collecting strip 4 in the length direction of the front dust collecting strip 41 is opposite to an outlet 33 of the air channel 3, the airflow which flows forwards and into the floor brush 100 through the front air inlet 41 is enabled to flow towards the outlet 33 of the air channel 3 directly, which reduces the compact between the airflow and the wall surfaces at left and right sides of the air channel 3 and lowers the compact noise.

Figure 7:
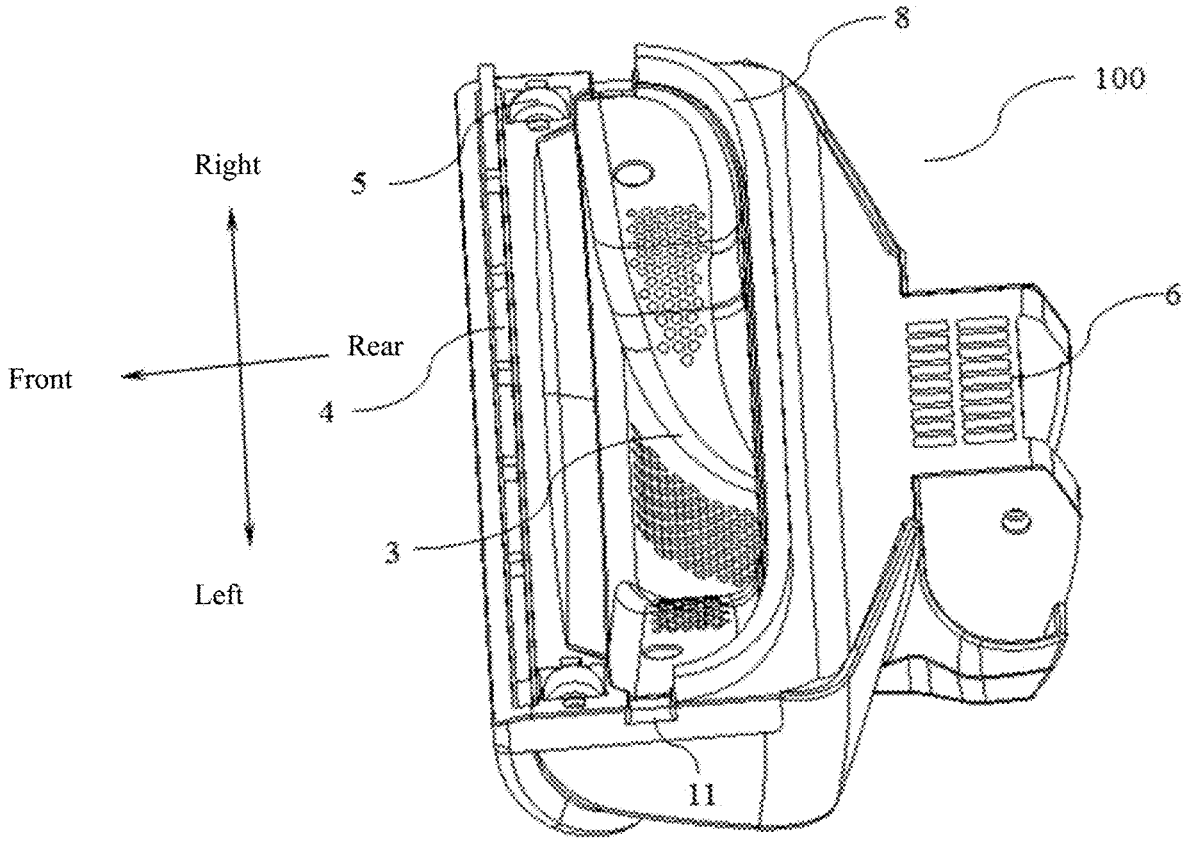
FIG. 7 is a schematic view of the floor brush for the cleaning appliance in FIG. 1 in another view.

According to an embodiment of the present disclosure, the floor brush 100 further includes a small supporting wheel 5 arranged at the left side and/or the right side of the front dust collecting strip 4. The small supporting wheel 5 is attached to the front dust collecting strip 4, or an element made of sealing material is filled between the small supporting wheel 5 and the front dust collecting strip 4. For example, as illustrated in FIG. 7, two small supporting wheels 5 are provided and arranged at a left end and a right end of the front dust collecting strip 4 respectively, and play a role of supporting the floor brush 100. Meanwhile, the two small supporting wheels 5 are both attached to a rear side of the front dust collecting strip 4, when the airflow enters the air channel 3 from the side, it can only flow into the air channel 3 from a rear side of the small supporting wheels 5, which eliminates karman vortex street caused by double-side flowing as a result of the fact that the small supporting wheels 5 are not attached to the front dust collecting strip 4, thereby reducing degree of turbulence of airflow entering the air channel 3. Meanwhile, interference from the side air intake on the airflow entering through the front air inlet 41 is also reduced for the single-side air intake at the small supporting wheels 5, which makes the airflow to flow stably, thereby lowering the aerodynamic noise. The term "karman vortex street" means that when steady flow in certain conditions flows past some objects, binary vortices with contrary rotation direction and regular arrangement shed from two sides of the objects periodically, and after nonlinear interaction, the karman vortex street is formed. Vibration occurs and sound effect appears when the karman vortex street sheds In one embodiment, and the sound is a sound wave caused by pressure pulsation in the fluid due to periodical shedding of the karman vortex street.

When the small supporting wheels 5 are not attached to the left side and/or the right side of the front dust collecting strip 4, an element made of sealing-material is filled between the small supporting wheels 5 and the front dust collecting strip 4 (not illustrated in the figures) so as to realize that airflow flows into the air channel 3 only from the rear side of the small supporting wheels 5, which can also eliminate the karman vortex street caused by double-side flowing as a result of the fact that the small supporting wheels 5 are not attached to the front dust collecting strip 4, lower the degree of turbulence of airflow entering the air channel 3, reduce the interference on the airflow from the front air inlet 41 and hence make the airflow to flow more stably, and lower the aerodynamic noise.

In one embodiment of the present disclosure, the air channel 3 has a first wall surface 31 and a second wall surface 32. The first wall surface 31 is connected with the rear end of the airflow guiding surface 21 and extends upwards and backwards and the second wall surface 32 is opposite to the first wall surface 31. For example, as illustrated in FIG. 5, the first wall surface 31 and the second wall surface 32 are opposite to each other in the up and down direction. The air channel 3 is defined between the first wall surface 31 and the second wall surface 32. The front end of the first wall surface 31 is connected to the rear end of the airflow guiding surface 21 and the first wall surface 31 can extend upwards and the backwards obliquely and smoothly. The second wall 32 can be an arc surface and/or a flat surface with smooth transition and similarly, extends upwards and backwards obliquely. Thus, when a part of the airflow obliquely and upwardly enters the air channel 3 along the tangential direction of the rear end of the rear airflow guiding surface 212, as the second wall surface 32 is inclined upwards and backwards, the part of the airflow is enabled to flow out through the outlet 33 of the air channel 3 directly, which reduces the collision of the airflow with the second wall surface 32 and hence reduces the occurrence of the vortex and lowers the airflow noise and the compact noise. Meanwhile, the airflow carrying the debris flows out through the air channel 3 smoothly without much hindrance, which improves the dust removal efficiency of the floor brush 100 when it cleans the surface 7.

In one embodiment, as illustrated in FIG. 2, an included angle γ 1 is formed at a position where the first wall surface 31 and the airflow guiding surface 21 are connected, and γ 1 satisfies that 90≤γ1≤130°. Thus, not only the airflow is enabled to enter the air channel 3 smoothly, but also a volume of a space of the air channel 3 is ensured, preventing blockage of the air channel 3 due to a too small volume.

According to an embodiment of the present disclosure, the smallest distance D1 between the second wall surface 32 and the surface 7 and the greatest distance D2 between the rear airflow guiding surface 212 and the surface 7 satisfy that D1≤D2, as illustrated in FIG. 2 and FIG. 5. Thus, when another part of the airflow which doesn't enter the air channel 3 upwardly and obliquely along the tangential direction of the rear end of the rear airflow guiding surface 212, the collision of the airflow with the front end of the second wall surface 32 is reduced, so that the occurrence of the vortex is reduced and the airflow noise and the compact noise are lowered.

In one embodiment, an included angle between a tangential line at any point on the second wall surface 32 and the surface 7 is γ 2, and γ 2 satisfies that $0<\gamma 2\leq 50$. When the second wall surface 32 is at least one flat surface and smooth transition is formed between any two adjacent flat surfaces of the at least one flat surface, the tangential line at any point on all of the at least one flat surface is parallel with the said at least one flat surface, in which case the included angle γ 2 between each of the at least one flat surface and the surface 7 satisfies that $0<\gamma 2\leq 50°$. When the second wall surface 32 is at least one arc surface and smooth transition is formed between any two adjacent arc surfaces of the at least one arc surface, the included angle γ 2 between the tangential line at any point on the arc surface and the surface 7 satisfies that $0<\gamma 2\leq 50°$. For example, as illustrated in FIG. 6, the second wall surface 32 is the flat surface, and the included angle γ 2 between the second wall surface 32 and the surface 7 satisfies that $0<\gamma 2\leq 50°$, thus, the collision of the airflow on the second wall surface 32 is reduced and the occurrence of the airflow vortex is reduced, so that the compact noise is lowered.

According to an embodiment of the present disclosure, a side air inlet 11 communicated with the air channel 3 is formed in at least one side of the body 1. In one embodiment, the side air inlets 11 communicated with the air channel 3 are formed in both sides of the body 1, as illustrated in FIG. 1, FIG. 5 and FIG. 7. When the floor brush 100 operates, the side airflow mixed with the debris on the surface 7 enters the air channel 3 through the side air inlet 11, so that the debris at the sides of the floor brush 100 can be cleaned and the dust removal efficiency can be improved.

Further, as illustrated in FIG. 7, the floor brush 100 further includes a connector 6 and a rear dust collecting strip 8. The connector 6 is configured to connect the floor brush 100 and the soft tube of the electric motor of the cleaning appliance (not illustrated in the figure). The rear dust collecting strip 8 is a villiform plate strip, which is made of plastic fiber, but is not limited to that. The rear dust collecting strip 8 plays a role of sealing the air channel 3, and thus the suction force of the airtight space is enhanced.

The cleaning appliance according to embodiments of the present disclosure includes a cleaning appliance body and the floor brush 100 according to embodiments of the present disclosure.

With the cleaning appliance according to embodiments of the present disclosure, by adopting the above-mentioned cleaning appliance 100, the noise produced when the cleaning appliance operates is reduced and the dust removal efficiency of the cleaning appliance is improved.

Other configurations and operations of the cleaning appliance according to embodiments of the present disclosure are known to those of ordinary skill in the art and will not be described in detail herein.

Reference throughout this specification to "an embodiment," "some embodiments," "illustrative embodiment," "an example," "a specific example," or "some examples" means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

What is claimed is:

1. A floor brush for a cleaning appliance, comprising:

a body having an air channel and a suction port in communication with the air channel, the air channel being formed in the body and the suction port being formed in a lower surface at a front end of the body, the air channel being configured to, when the body covers a surface to be cleaned, form a closed space between the air channel and the surface to be cleaned, and a front air inlet in communication with the air channel being formed at the front end of the body; and an airflow guiding portion configured at the front end of the body and adjacent to the front air inlet, the airflow guiding portion having an airflow guiding surface located in a lower surface of the airflow guiding portion so that external air enters the air channel through the front air inlet and the airflow guiding surface;

wherein the airflow guiding surface comprises a front airflow guiding surface and a rear airflow guiding surface, the front airflow guiding surface is inclined downwards from front to rear, and the rear airflow guiding surface is inclined upwards from the front to the rear;

wherein the front airflow guiding surface, the front air inlet, the rear airflow guiding surface and the suction port are arranged in sequence from the front to the rear.

2. The floor brush according to claim 1, wherein the at least one of the front airflow guiding surface and the rear airflow guiding surface is formed into at least one arc surface, at least one flat surface, or a combination of at least one arc surface and at least one flat surface.

3. The floor brush according to claim 1, wherein the front airflow guiding surface is configured so that an included angle α between a tangential line at any point in the front airflow guiding surface and the surface to be cleaned is less than 60°.

4. The floor brush according to claim 1, the rear airflow guiding surface is configured so that an included angle β between a tangential line at any point in the rear airflow guiding surface and the surface to be cleaned is less than 20°.

5. The floor brush according to claim 1, a length L1 of a projection of the front airflow guiding surface on the surface to be cleaned in a front and rear direction is greater than 2 mm, and a length L2 of a projection of the rear airflow guiding surface on the surface to be cleaned in the front and rear direction is greater than 6 mm.

6. The floor brush according to claim 1, further comprising a front dust collecting strip, wherein the front dust collecting strip is arranged at the front end of the body and the front air inlet is formed in the front dust collecting strip.

7. The floor brush according to claim 6, wherein the front dust collecting strip is located between the front airflow guiding surface and the rear airflow guiding surface.

8. The floor brush according to claim 6, wherein a groove being recessed upwards is formed in a part, located between the front airflow guiding surface and the rear airflow guiding surface, of the airflow guiding portion, an upper end of the front dust collecting strip extends into the groove and a lower end of the front dust collecting strip extends downwards and exceeds the airflow guiding portion so as to support the floor brush on the surface to be cleaned.

9. The floor brush according to claim 8, wherein the smallest value C of a vertical distance between the upper end of the front air inlet and the airflow guiding surface is less than or equal to 2 mm.

10. The floor brush according to claim 6, wherein a plurality of front air inlets are provided and formed in the front dust collecting strip at intervals.

11. The floor brush according to claim 6, further comprising a small supporting wheel, wherein the small supporting wheel is arranged at a left and/or right side of the front dust collecting strip, the small supporting wheel is attached to the front dust collecting strip or an element made of sealing material is filled between the small supporting wheel and the front dust collecting strip.

12. The floor brush according to claim 1, wherein the air channel comprises a first wall surface and a second wall surface, the first wall surface is connected to a rear end of the airflow guiding surface and obliquely extends upwards and backwards, and the second wall surface is opposite to the first wall surface.

13. The floor brush according to claim 12, wherein an included angle γ 1 is formed at a joint between the first wall surface and the airflow guiding surface and the included angle γ 1 is greater than or equal to 90 degree and less than or equal to 130 degree.

14. The floor brush claim 12, wherein the smallest distance D1 between the second wall surface and the surface to be cleaned and the greatest distance D2 between the rear airflow guiding surface and the surface to be cleaned satisfy that D1 is less than or equal to D2.

15. The floor brush according to claim 12, wherein an included angle between a tangential line at any point on the second wall surface and the surface to be cleaned is γ 2, and the included angle γ 2 is greater than 0 degree and less than or equal to 50 degree.

16. The floor brush according to claim 1, wherein a side air inlet communicated with the air channel is formed in at least one side of the body.

17. A cleaning appliance, comprising:

a cleaning appliance body; and a floor brush for a cleaning appliance, comprising:

a body having an air channel and a suction port in communication with the air channel, the air channel being formed in the body and the suction port being formed in a lower surface at a front end of the body, the air channel being configured to, when the body covers a surface to be cleaned, form a closed space between the air channel and the surface to be cleaned, and a front air inlet in communication with the air channel being formed at the front end of the body; and an airflow guiding portion configured at the front end of the body and adjacent to the front air inlet, the airflow guiding portion having an airflow guiding surface located in a lower surface of the airflow guiding portion so that external air enters the air channel through the front air inlet and the airflow guiding surface, wherein the floor brush is communicated with the cleaning appliance body by a connecting tube;

wherein the airflow guiding surface comprises a front airflow guiding surface and a rear airflow guiding surface, the front airflow guiding surface is inclined downwards from front to rear, and the rear airflow guiding surface is inclined upwards from the front to the rear;

wherein the front airflow guiding surface, the front air inlet, the rear airflow guiding surface and the suction port are arranged in sequence from the front to the rear.

* * * * *